United States Patent [19]

Janson

[11] 4,337,701

[45] Jul. 6, 1982

[54] ELECTROMECHANICAL WARHEAD SAFETY-ARMING DEVICE

[75] Inventor: James G. Janson, China Lake, Calif.

[73] Assignee: The United States of America as represented by the Secretary of the Navy, Washington, D.C.

[21] Appl. No.: 115,989

[22] Filed: Jan. 28, 1980

[51] Int. Cl.[3] ..... F42C 15/24; F42C 15/34

[52] U.S. Cl. ..... 102/249; 102/264

[58] Field of Search ..... 102/248, 249, 232, 233, 102/264

[56] References Cited

U.S. PATENT DOCUMENTS

| | | | |
|---|---|---|---|
| 3,139,828 | 7/1964 | Delaney et al. | 102/264 X |
| 3,388,667 | 6/1968 | Voida et al. | 102/248 |
| 3,498,225 | 3/1970 | Voida et al. | 102/248 |
| 3,554,128 | 1/1971 | Hoelzen et al. | 102/248 |
| 3,738,273 | 6/1973 | Hoelzen | 102/264 |
| 3,906,861 | 9/1975 | Hamilton et al. | 102/249 |
| 3,976,011 | 8/1976 | Crescas et al. | 102/248 |

*Primary Examiner*—David H. Brown

*Attorney, Agent, or Firm*—Robert F. Beers; W. Thom Skeer; Kenneth G. Pritchard

[57] ABSTRACT

A safety and arming device using two counter-rotating gears provides stability from acceleration forces. The gears have a natural tendency to compensate for lateral shifts which tend to speed up or slow down any one single gear. The gears are anchored by a setback weight which when released is driven back by acceleration freeing the gears to rotate due to inertia effects. Upon completion of the rotation, the detonator switch is keyed to permit fuze detonation. The time required for the gears to rotate is controlled by an escapement device.

4 Claims, 13 Drawing Figures

ELECTROMECHANICAL WARHEAD SAFETY-ARMING DEVICE

BACKGROUND OF THE INVENTION

1. Field of the Invention

This device pertains to safety and arming devices for fuzes used in warheads. In particular, it pertains to safety and arming devices requiring dual mode initiation, such as mechanical-electrical conditions, prior to the safety devices being removed for detonation. In even greater particularity, the present invention pertains to devices using a mechanical timer which is not prone to change its timing due to lateral forces acting on the timing device.

2. Description of the Prior Art

U.S. Pat. No. 3,498,225 to Voida et al. is a patent for a counter-rotating dual rotor safety and arming mechanism. The Voida et al. patent provides counter rotating weights to offset the influence of lateral acceleration forces encountered due to motion of a missile. Such motion is due to steering and buffeting of the missile as it moves through the atmosphere. The Voida et al. patent uses a linear arrangement of rotors and setback weight to provide a single action firing device. A pair of coil compression return springs are mounted in the Voida et al. patent so that it can function as a fly forward device.

U.S. Pat. No. 3,554,128 to Hoelzen is for a method of modifying the device taught in the Voida et al. patent so that it can be tested and reset without destroying the integrity of the safety-arming device. The Hoelzen patent is an improvement of the Voida et al. device. As such, it contains some of the limitations of the Voida et al. device. These include the need to turn the device in a preferred direction to reset everything along a singular linear axis, that the safety-arming device has to comprise a main body element covered with a top plate and a bottom plate, and the use of coil compression return springs for guiding the longitudinal motion of a set back weight.

The device taught in the Voida et al. and Hoelzen patents does not improve reliability to any significant degree. The in-line arrangement of rotors is still subject to timing shifts despite the counter balancing and control timing by an escapement device. It has also been found that the Voida et al. device requires an acceleration above one g for the device to successfully function. As a result, firing efficiency places a premium on missiles obtaining a predetermined cut off acceleration. The balancing of the rotors in the Voida device is a critical consideration and slight imbalance in the cast rotors prevents the device from working in the idealized fashion described. Lastly, the in-line arrangement requires an in-line firing train. This firing train fails if any component along the line fails. Even with an improved shelf life, the pyro-technical device used as an explosive lead could still fail resulting in total failure of the system.

SUMMARY OF THE INVENTION

An improved dual rotor safety and arming device is created by placing counter-rotating rotors in a side-by-side configuration relative to the overall direction of motion. The side-by-side placement creates an unexpected improvement in the ability of the rotors to compensate for lateral acceleration effects on a missile than that of the in-line arrangement of rotors used previously. Each rotor has an offset center of gravity placed so the rotors rotate in opposed directions while intermeshed with surface gears. One of the rotors is locked in place by a pin on a setback weight. The setback weight is in turn held in place by a locking pin attached to a solenoid.

Upon receipt of an appropriate enabling signal, the locking pin is withdrawn, pulled out, by the solenoid leaving the setback weight free to move. Upon reaching a predetermined acceleration, the setback weight is depressed enough to remove the pin holding the rotors. The rotors are then free to move under the influence of missile acceleration. The rotors are connected to an escapement device which controls the time period it takes the rotors to turn to the armed position.

One of the rotors is connected to a switch. Upon reaching its final position, the switch is turned from the off to the on position. The switch closes a circuit to the firing detonators which are fired upon the occurrence of impact or a signal from some other predetermined targeting device.

The present invention uses multiple detonators to improve reliability. The shelf life of safety and arming devices is extended when two or more separate detonator firing routes are available.

DESCRIPTION OF THE PREFERRED EMBODIMENT

Figure 1:
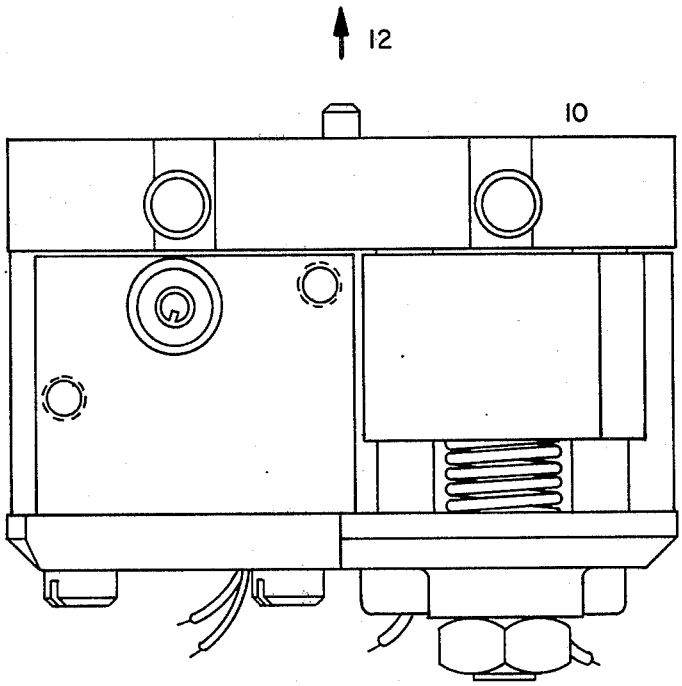
FIG. 1 is the front view of the present invention.

FIG. 1 shows a front view of the present invention 10 oriented with the expected direction of acceleration 12 that a missile or other delivery vehicle might travel containing the present invention.

FIG. 2 again shows safety arming device 10, this time from a side perspective. Shown are an outboard support assembly 14, a support cap assembly 16, and a cutaway of section support screw 18.

Figure 3:
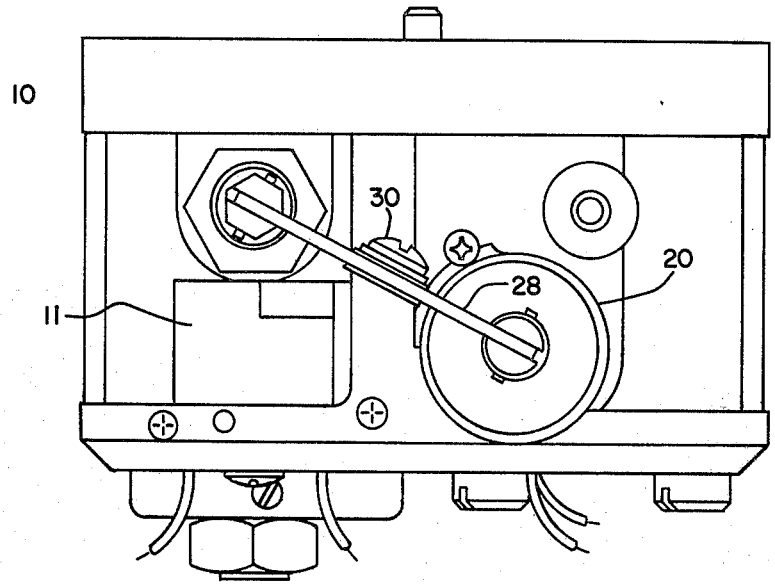
FIG. 3 is the back view of the present invention.

FIG. 3 shows the back side of safety and arming device 10 including fuze triggering device 11 and solenoid assembly 20.

Figure 2:
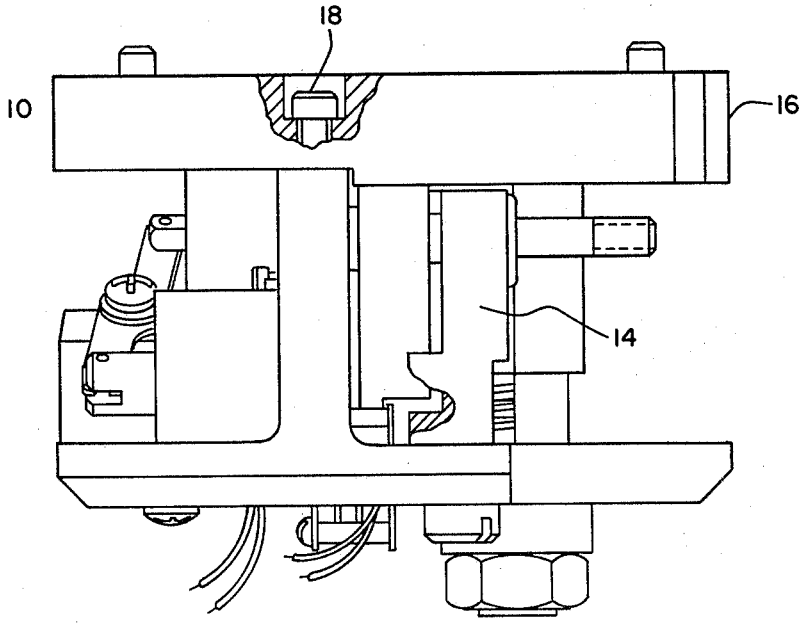
FIG. 2 is the left side view of the present invention.
Figure 4:
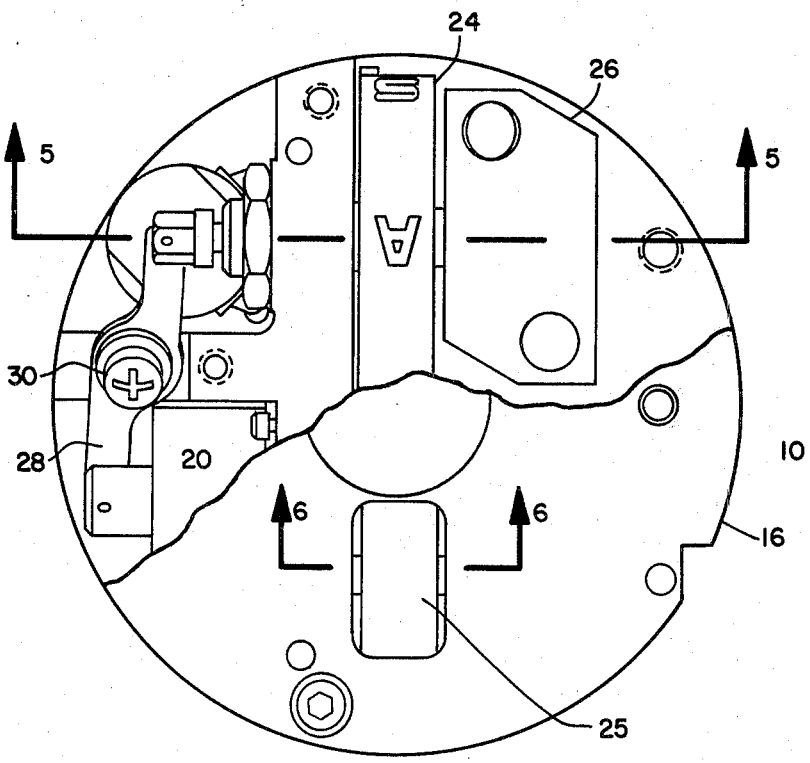
FIG. 4 is a cutaway top view of the present invention.

FIG. 4 shows a top view of safety and arming device 10 that corresponds to a top view perspective of FIG. 2. The top section of support cap assembly 16 is cutaway to show the internal mechanism. Shown in FIG. 4 are rotors 24 and 25. Rotor 24 is the control rotor because it is connected to an escapement device. Rotor 25 is a counter rotor to rotor 24. Rotor 25 brakes or accelerates in opposition to acceleration or braking of rotor 24 due to lateral loads. Connected to solenoid assembly 20 is a bell crank 28 which is pivoted at point 30.

Figure 5:
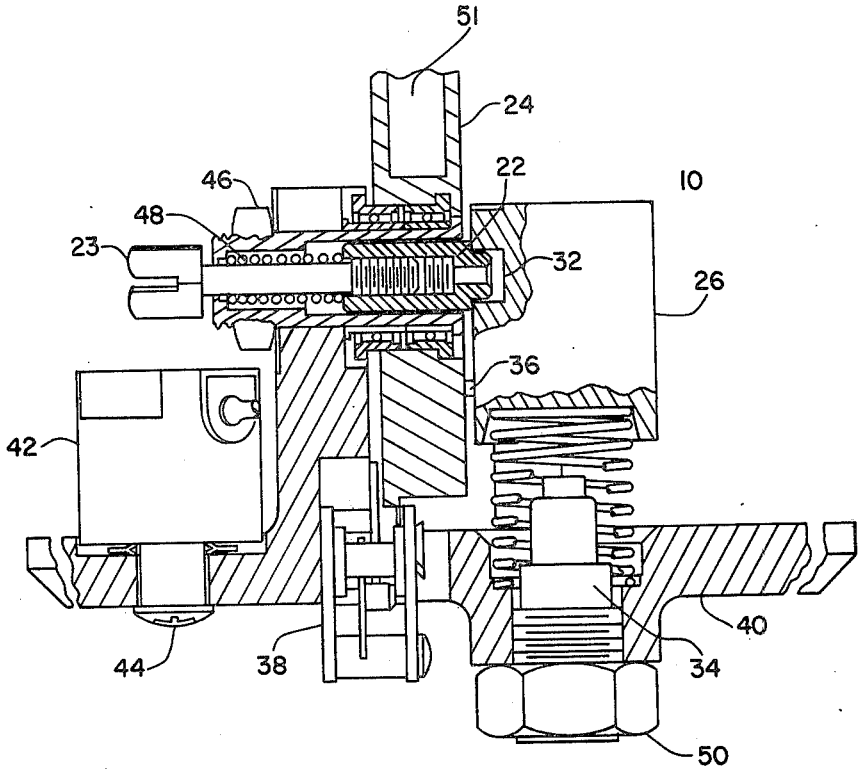
FIG. 5 is a cutaway view along the sectional line 5—5 shown in FIG. 4.

FIG. 5 is a cutaway view of the present invention 10 along line 5—5 of FIG. 4. A clevis latch 23 has a latch pin 22 shown passing through control rotor 24 into a recessed opening 32 on setback weight 26. Unless latch pin 22 is withdrawn from recess 32, setback weight 26 is locked into position and is not capable of being depressed along its guide rods, which are not shown. Clevis latch 23 is used to pull latch pin 22 from recess 32. Setback weight 26 has a pin 36 which goes into control rotor 24. Connected to control rotor 24 is an escapement device 36 which is a series of gears that controls how fast control rotor 24 can turn. Setback weight 26, clevis latch 23, escapement 38 and so forth are mounted on a support 40. A fuze triggering device 42 is mounted to support 40 by a screw 44. Anchoring clevis latch 23 in place is a retaining nut 46. Behind clevis latch 23, a latch spring 48 keeps latch pin 22 from accidentally slipping out of recess 32 until the solenoid is activated. A spring plunger assembly 34, which supports setback weight 26, is mounted to support 40 by retaining nut 50. A compartment 51 is shown in control rotor 24 for holding an explosive lead.

Figure 6:
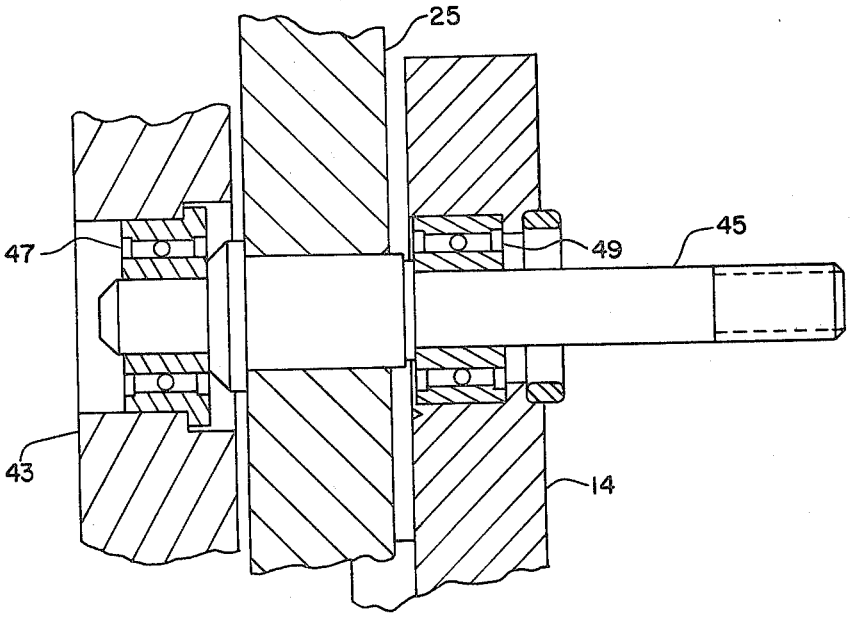
FIG. 6 is a cutaway along the line 6—6 of FIG. 4.

FIG. 6 is a cross sectional view along lines 6—6 of FIG. 4. This is a cross sectional view through counter rotor 25 for comparison purposes with FIG. 5. Counter rotor 25 is mounted on a counter rotor shaft 45 and suspended between bearings 47 and 49 in supports 43 and 14.

Figure 7:
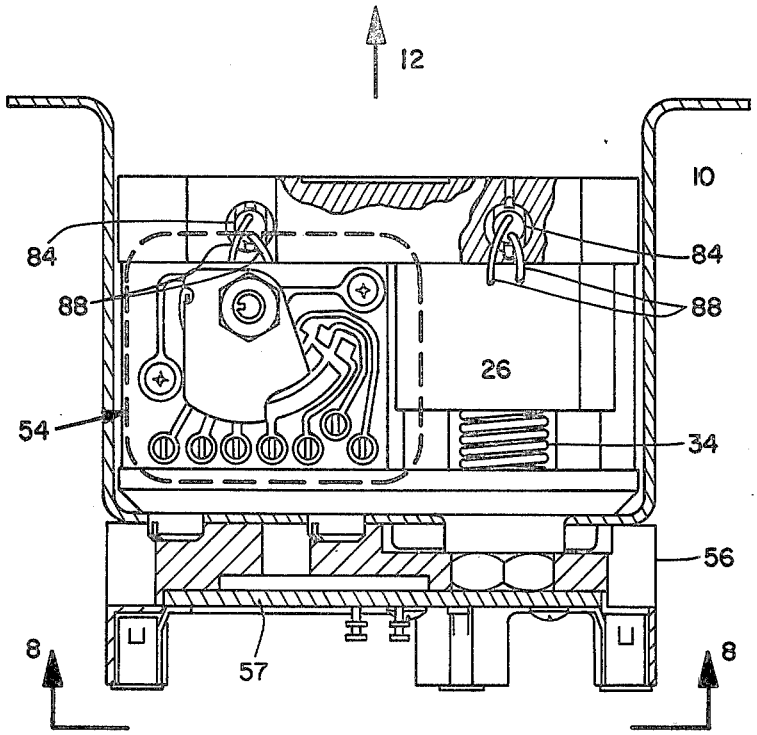
FIG. 7 is a cutaway front view of the present invention.

FIG. 7 is a side cross sectional view of safety arming device 10. A firing switch 54 is shown surrounded by a dashed line. Electrical connections are made to a circuit board 57 attached to a base 56 on the bottom of safety and arming device 10.

Figure 8:
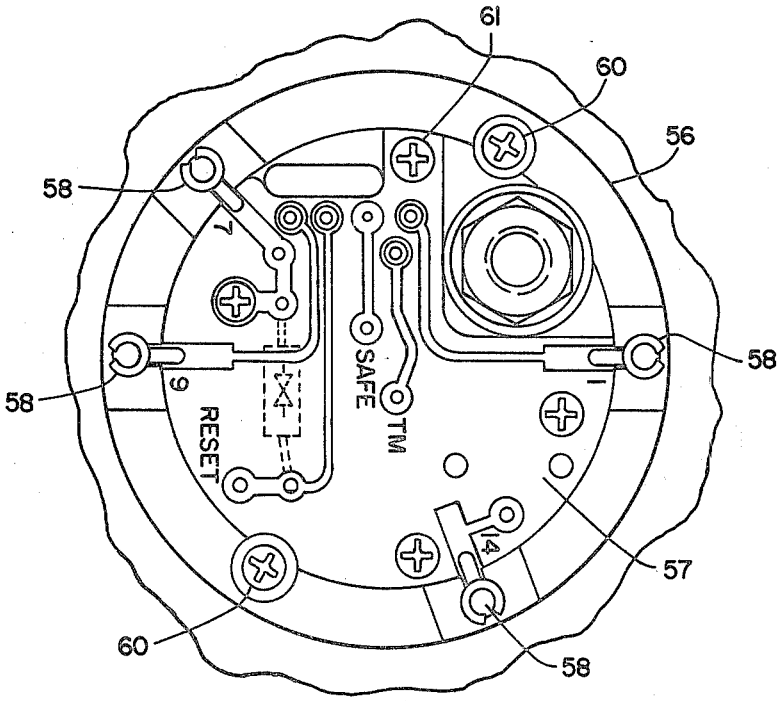
FIG. 8 is a bottom view of the present invention along the line 8—8 shown in FIG. 7.

FIG. 8 is a bottom view along line 8—8 of FIG. 7. Electrical connections can be made via clips 58. Base 56 can be connected to safety and arming device by screws 60 or other fastening devices. Fastening devices 61 hold circuit board 57 to base 56 at the four places shown.

Figure 9:
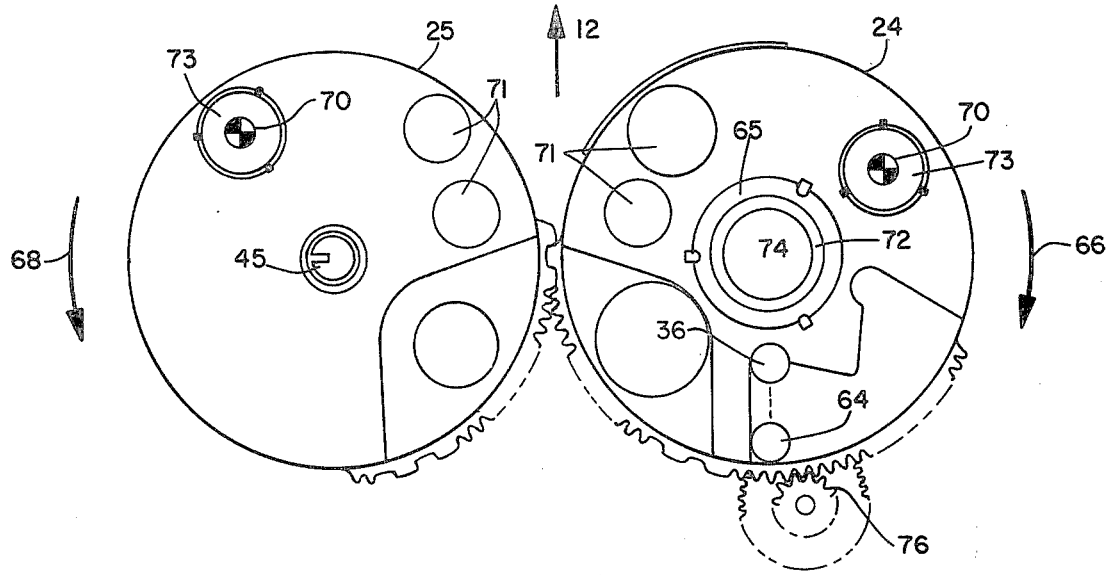
FIG. 9 shows the gear arrangement of the present invention.

FIG. 9 shows the orientation of rotor pair 24 and 25. The general direction of the arming device is shown again by arrow 12. A pin 36 is connected to setback weight 26 as shown previously. It fits in a notched arrangement of control rotor 24. The notch is in the form of an inverted letter, W. Control rotor 24 is locked into position when pin 36 is in the position shown. Neither rotor can move until pin 36 moves to position 64 by depression of setback weight 26. When pin 36 moves to position 64, the rotor pair moves as shown by arrows 66 and 68 in opposing directions. This is made possible by an offset center of gravity 70 in each pair which occurs above and to the side of the center rotor shaft 45 and 72 in their rotor pair. Center 74 of control rotor 24 is a larger diameter to allow installation of two bearings 65, control rotor shaft 72, and latch pin 22, shown previously. Latch pin 22 passes through control rotor shaft 72. The first gear 76 on an escapement device is shown being driven by control rotor 24. However, the escapement device can be driven by any other reasonable placement of first gear 76. Once control rotor 24 has turned, setback weight 26 can return to its starting position without interfering with control rotor 24 because pin 36 will be on the opposite side of the inverted W. In each rotor, center of gravity 70 has been shifted by removal of material from the rotors. This is shown by openings 71. A mass counterweight 73 is added to further shift center of gravity 70.

Figure 10:
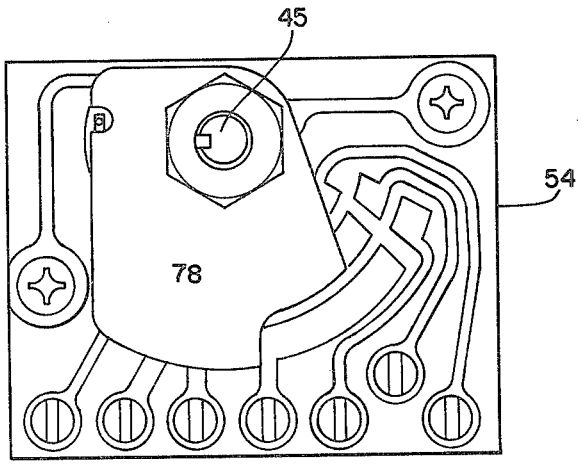
FIGS. 10 and 11 show the on and off positions of a firing switch to be used with the present invention.
Figure 11:
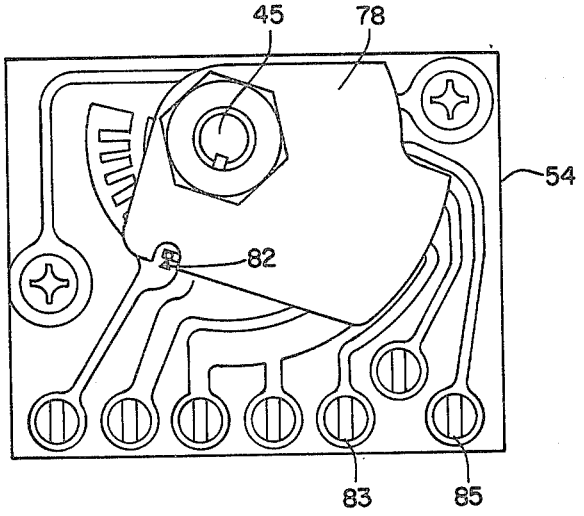

FIGS. 10 and 11 show a close-up view of switch 54 from FIG. 7. Switch 54 has a rotor assembly 78 which is in the "off" position in FIG. 10. In FIG. 11, rotor 78 has rotated to the "on" position by the rotation of counter rotor shaft 45 which is fixed to the counter rotor, shown previously. A setting aid 82 is included on switch 54 to insure proper alignment of rotor 78 when the device is assembled. Setting aid 82 comprises a small mark, which is etched on switch 54 and can be seen through a notch on rotor 78, to permit ease in viewing the contact setting point. Terminals 83 and 85 are examples of output terminals where detonator wires are attached.

Figure 12:
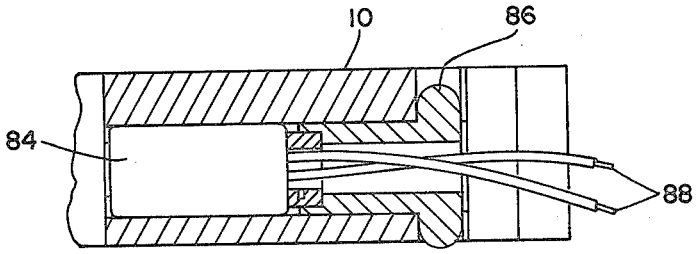
FIG. 12 shows a cross section of a detonator to be used with the present invention.

FIG. 12 shows a cross sectional view of a detonator assembly 84 which is contained within a wall of safety arming device 10. Detonator 84 is held in place by a retaining ring 86. Detonator 84 consists of any appropriate explosive, which is triggered through wire leads 88, connected to terminals 83 and 85 of switch 54. The electrical powering device for the detonator can be any capacitor discharge circuit powered by a battery or generator.

The device has a dual arrangement of detonator assemblies 84 with electric detonators connected in parallel. They fire into dual explosive leads, one in each rotor, which gives the system complete redundancy.

Figure 13:
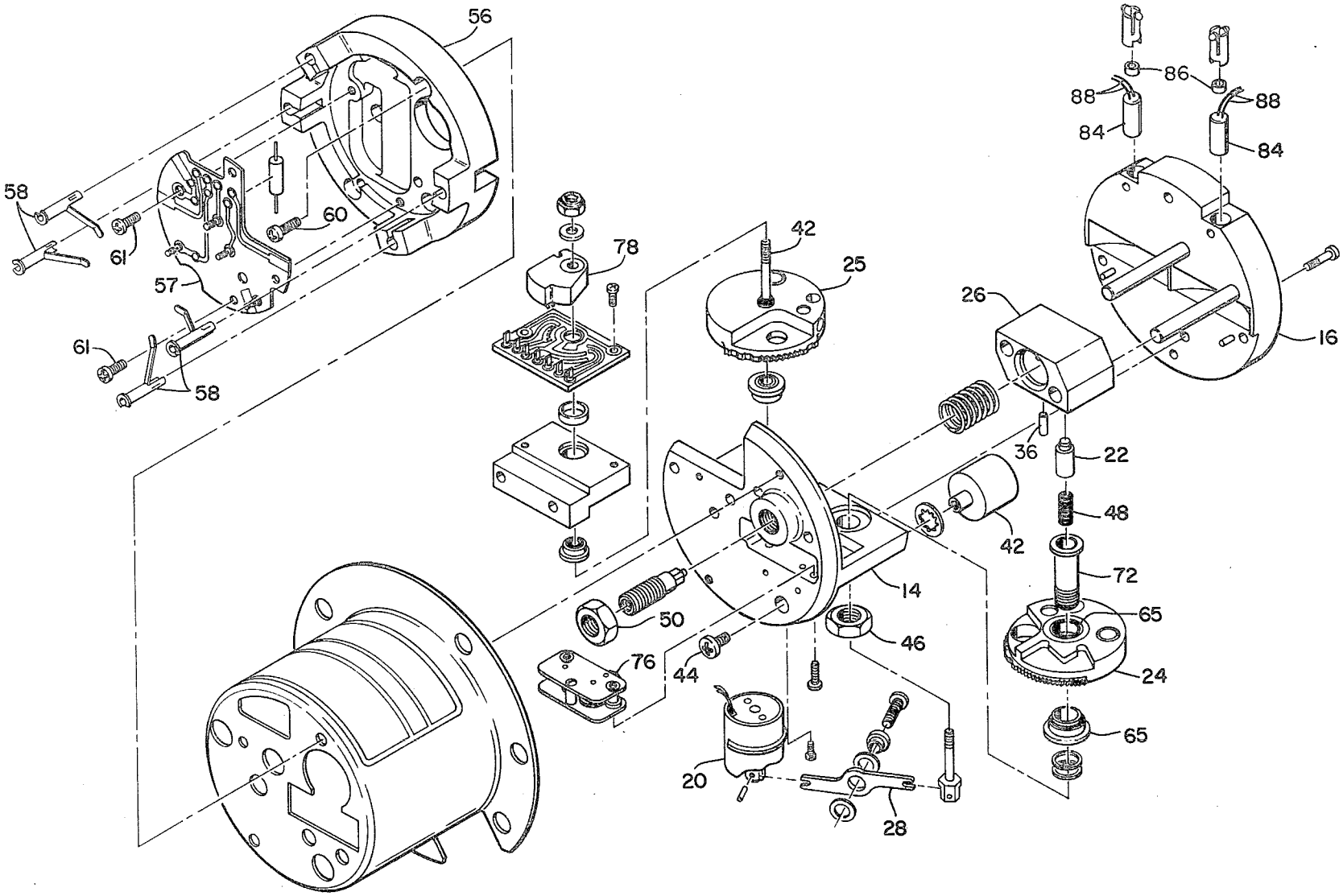
FIG. 13 shows an exploded view of the present invention.

FIG. 13 shows an exploded view of the present invention with numbers of components as described previously.

It is obvious to those skilled in the art that numerous variations and modifications of the principle disclosed can be made to create similar devices taking advantage of the new teaching set forth herein.

I claim:

1. A warhead safety-arming device comprising:

a pair of rotors side by side with meshed geared surfaces, said rotors having centers of gravity such that said rotors are driven in opposing directions due to inertial effects on said centers of gravity;

a setback weight attached to one of said rotors for locking in a predetermined position said rotor pair, whereby said rotor pair is free to turn upon depression of said setback weight by a predetermined acceleration;

a solenoid assembly connected to said rotors;

a clevis latch pin mounted so it fits into said setback weight for holding said setback weight in position;

a bellcrank connecting said solenoid assembly and said clevis latch pin for withdrawing said clevis latch pin from said setback weight when said solenoid assembly is activated;

a releasing means connected to said solenoid assembly for unlocking said setback weight;

an escapement engaged to one of said rotors for timing the period said rotor pair is driven when said setback weight is depressed;

a switch electrically connected to at least one of said rotor pair such that it is kept from an on configuration until said rotor pair can no longer be driven by inertia; and at least one detonator electrically connected to said switch which is armed when said switch is in said on configuration.

2. A warhead safety-arming device as described in claim 1 wherein said releasing means is an electrical source connected to said solenoid assembly such that an electrical signal to said solenoid assembly causes said bellcrank to withdraw said clevis latch pin.

3. A warhead safety-arming device comprising:

a pair of bearing mounted rotors side by side with meshed geared surfaces, said rotors having centers of gravity such that said rotors are driven in opposing directions due to inertial effects on said centers of gravity;

a setback weight attached to one of said rotors for locking in a predetermined position said rotor pair, whereby said rotor pair is free to turn upon depression of said setback weight by a predetermined acceleration;

a solenoid assembly connected to said rotors;

a clevis latch pin mounted so it fits into said setback weight for holding said setback weight in position;

4. A warhead safety-arming device as described in any of claims 1, 2 or 6 wherein said setback weight locks said rotors by a device comprising a pin firmly fastened to said setback weight and an inverted W slot on one of said rotors which locks said rotor pair until said pin is depressed, said rotor pair free to move after said pin depression even if said setback weight returns to its starting position because said pin will be on the opposite side of said inverted W.

* * * * *